United States Patent [19]

Takizawa et al.

[11] Patent Number: 4,962,648

[45] Date of Patent: Oct. 16, 1990

[54] REFRIGERATION APPARATUS

[75] Inventors: Takashi Takizawa; Kiyoshi Ohshimizu, both of Gunma; Ken Aoki, Tochigi; Hirotaka Nakano, Gunma; Hiroyuki Kuribara, Saitama, all of Japan

[73] Assignee: Sanyo Electric Co., Ltd., Osaka, Japan

[21] Appl. No.: 310,449

[22] Filed: Feb. 13, 1989

[30] Foreign Application Priority Data

Feb. 15, 1988 [JP] Japan ..... 63-32217
Feb. 24, 1988 [JP] Japan ..... 63-41538
Apr. 15, 1988 [JP] Japan ..... 63-94222

[51] Int. Cl.[5] ..... F25B 5/00; F25B 41/04
[52] U.S. Cl. ..... 62/199; 62/217
[58] Field of Search ..... 62/197, 199, 200, 217, 62/223, 224, 225, 126, 129, 113, 513, 211

[56] References Cited

U.S. PATENT DOCUMENTS 2,948,125 8/1960 Lawler ..... 62/199
3,257,819 6/1966 Maloney ..... 62/199
3,914,952 10/1975 Barbier ..... 62/217 X
4,313,308 2/1982 Boratgis et al. ..... 62/126
4,499,739 2/1985 Matsuoka et al. ..... 62/197 X
4,790,143 12/1988 Hanson ..... 62/129 X

FOREIGN PATENT DOCUMENTS 0034037 8/1985 Japan .
0056983 12/1985 Japan .
0235664 10/1986 Japan .
1314341 4/1973 United Kingdom ..... 62/199

*Primary Examiner*—Harry B. Tanner
*Attorney, Agent, or Firm*—Darby & Darby

[57] ABSTRACT

The refrigeration apparatus according to the invention has a main refrigeration line comprising a compressor, a condenser which are installed outdoor, and a decompression device, an evaporator and a refrigerant flow rate control valve which are installed indoor, all connected in a loop. The main refrigerant line is provided with an auxiliary refrigerant line that connects the input side of the decompression device in the main refrigerant line with the inlet side of the compressor via a bypass valve. The lowering in the suction pressure of the compressor is detected if it happens, and the pressure is restored by opening the bypass valve by throttling the refrigerant flow rate control valve, so that the compressor may be kept on running.

6 Claims, 6 Drawing Sheets

REFRIGERATION APPARATUS

BACKGROUND OF THE INVENTION

This invention relates to a large refrigeration apparatus such as a prefabricated refrigerator for professional use, suitable for preserving foods at constant temperature independently of the change in refrigerating load such as the amount of the foods stored therein and the opening of the doors.

DESCRIPTION OF THE PRIOR ART

In order to maintain constant the refrigerating room temperature in such a refrigerator as mentioned above, one usually employs ON-OFF control or control of the running power of the compressor For example, among various types of the latter methods so far proposed are methods in which the number of the poles of the motor of the compressor is changed (e.g. 2p⟷4p) or an inverter is used (hereinafter referred to as an inverter method) Since inverters have been improved in their performance and durability, they play major roles of variable-speed control of a compressor. Japanese Patent Publication No. 61-235664 discloses an example utilizing an inverter.

However, in carrying out the temperature control by means of aforementioned ON-OFF control, due in part to the mechanically-limited response, the amplitude of room temperature variation is great and hence it is impossible to meet the requirement that the temperature be maintained within ±−0.5° C. about a preset temperature as required in some fields e.g. in super-chilled temperature control applications required for preserving foods in a non-freezing but super-chilled state. (In contrast to pure water which freezes at 0° C., foods have different freezing temperatures lower than 0° C. due to the fact that they contain various compositions. The temperature range below 0° C. and just above the freezing temperature of a food is called super-chilled temperature. It is assumed to be 0° C.∼−4° C. in this example.) On the other hand, in the inverter control described in the above publication, a heating system (which specifically comprises heaters such as electric wires) is placed in operation when the roo temperature tends to lower as the rotational speed of the compressor motor is slowed down to the minimum speed depending on the load condition. However, this controlled heating initiated upon a heating instruction generally takes time to substantially heat the refrigerating room, thereby delaying heating and making it difficult to maintain precise temperature control. Furthermore, this method suffers from a disadvantage that inverters and variable-speed a compressor, and hence the over-all system as well, are rather expensive.

An alternative method has been known in controlling the room temperature in which a compressor are run at a nominal speed while the temperature is controlled by adjusting the opening of a control valve provided in the refrigerant loop therefor. There are several types of valves for this purpose. Among them are electric expansion valves, which are well known for their excellent response ability. Some of these electric expansion valves regulate the openings by means of motors, while others regulate the openings by varying the forces exerted by the springs abutting thereto. The present invention employs those valves as shown in the Japanese Paten Publication Nos. 60-56983 and 60-34037 which belong to the latter types of the valves. In Japanese Patent Publications No. 60-56983 the change in the temperature (of the refrigerant) near the outlet side of an evaporator is converted into an electric signal, which in turn controls the opening of the valve. On the other hand in Japanese Patent Publication No. 60-34037, a control circuit outputs electric signals to keep the electric expansion valve fully open until an electric signal provided by a third temperature sensor installed at a point near the inlet of the evaporator or at an intermediate point of the fluid line reaches a predetermined value.

However, in an electric expansion valve comprising a spring and a solenoid constituting the electric expansion valve, the hysteresis of the solenoid becomes great for smoothly varying applied voltages and for higher frequencies. This characteristic causes a delay in the opening regulating response of the valve. In the worst case the valve does not operate at all, so that the valve response will become extremely poor.

In neither Japanese Patent Publications any improvements have been made with the electric expansion valves for better response to the signals given thereto. Consequently, they suffer from a disadvantage that their valve opening control is slow and hence unable to eliminate the room temperature variation.

In order to maintain the temperature as prescribed it is further necessary to have some protection means to detect a malfunction that might take place. However, the protection means disclosed in Japanese Patent Publication No. 60-42858 is not reliable under bad conditions due to the fact that the protection means uses semiconductor devices.

BRIEF SUMMARY OF THE INVENTION

A major object of the invention is to provide a refrigeration apparatus that may maintain the temperature in a refrigerating room independently of the change in the refrigeration load such as the amount of the food stored therein and the opening of the doors.

Another object of the invention is to give a better control on the temperature fluctuations by improving the opening characteristics in response to the input signal, of the control valve provided in a refrigerant line of a refrigerating apparatus.

Further object of the invention is to provide a refrigeration apparatus that may maintain the refrigerating room temperature within a desired temperature range even when temperature sensors and/or temperature control devices fail to function.

In order to attain these objects, a refrigeration apparatus in accordance with the invention is provided with a major refrigerant line which comprises a compressor, a condenser, an expansion device, and an evaporator all arranged in a loop, characterized in that said refrigeration apparatus further comprises:

- a refrigerant flow rate control valve installed at the outlet side of said evaporator;
- an auxiliary refrigerant line for bypassing said evaporator and a refrigerant flow rate control valve, having a refrigerant-line opening-closing means, a an expansion means, and an auxiliary evaporator, and installed between the outlet side of said condenser and the outlet side of said refrigerant flow rate control valve; and
- a low-pressure switch installed at the inlet side of said compressor for controlling the ON-OFF operations of said refrigerant-line opening-closing means, and that said compressor is run without interruption and, as the suction pressure of the compressor lowers below a predetermined value, said low-pressure switch functions to operate, making the refrigerant-line opening-closing means open.

In this case the refrigeration means is preferably provided with a temperature setting device for setting a preferable room temperature, temperature sensors for detecting the room temperatures, and a valve opening regulating device for controlling the opening of said refrigerant flow rate control valve in response to the temperature signals given by said temperature sensors and the temperature setting signal given by said temperature setting device.

Having the refrigeration apparatus so constituted, the flow rate of the refrigerant is controlled by the flow rate control valve depending on the refrigeration load in the room and the ambient temperature so as to regulate the refrigeration power and to maintain the temperature constant in the room. As the ambient temperature becomes too low or the refrigeration load in the room becomes too small, resulting in excessive throttling of the flow rate control valve and hence lowering of the suction pressure below the permitted range of utilization, the low pressure switch detects the suction pressure and causes to open an opening-closing valve. This establishes a bypass circuit for the refrigerant coming out of the condenser, so that a part of the refrigerant may escape into the bypass circuit and evaporate in a portion of an auxiliary evaporator and flow into the inlet pipe in the form of a gas to increase the vapor pressure therein.

Thus, the suction pressure into the compressor will not be lowered so that normal operation thereof is secured, regardless of the amount of the refrigeration load, and that efficient refrigeration is maintained, providing a constant room temperature.

The above refrigerant flow rate control valve is preferably provided with a spring for constantly acting a force on the valve to make it open, and a solenoid for closing the valve against the spring force. The valve opening regulating device preferably provides the solenoid with electric signals based on the difference between the temperature signals given by the temperature sensors and the preset temperature signals.

Since the hysteresis of the magnetization of the core caused by the magnetic field of the solenoid is proportional to the frequency of the change in current directions, the magnitude of the hysteresis may be minimized by changing the directions of the current through the solenoid. Further, it is possible to improve the response of the control valve by chosing the frequency as close as possible to the resonance frequency of the spring, but avoiding the resonance frequency itself, so as to make the amplitude of the hysteresis small.

The valve opening regulating device preferably comprises:

an operation device that carries out operations for control on the difference between the signals given by said temperature sensors and the temperature presetting device;

a correction device that decides whether the operated values are increasing, decreasing, or invariant by comparing the present output from the operation device with the preceding one, and outputs corrected values obtained by, depending on the decision, adding to or subtracting from the present value a value equivalent to the operating hysteresis (which will be hereinafter referred to as an operating hysteresis equivalent), or doing nothing with the present value, respectively;

a comparing device that compares the corrected values with a lump of signals having a given period and provides the solenoid of said refrigerant flow rate control valve with the electric signals having a duty ratio corresponding to the result of the comparison.

In this manner, the influence of the hysteresis of the refrigerant flow rate control valve itself may be suppressed. In particular, the response characteristic of the valve is greatly improved when the valve opening is increased or decreased under such control.

As a protection means, the refrigeration apparatus according to the invention is preferably provided with an overheating-prevention thermostat for fully opening the refrigerant flow rate control valve forcibly upon detection of an abnormally high temperature in the room, and an undercooling-prevention thermostat for forcibly stopping the compressor upon the detection of an abnormally low room temperature.

It is thus possible by provision of such protective means having such thermostats as above to quickly restore the preset room temperature by forcibly and fully opening the refrigerant flow rate control valve independently of the output signal of the valve opening control device even in the event of an abnormally high room temperature, and by stopping the operation of the compressor in the event of abnormally low room temperature, thereby providing a reliable refrigerating apparatus.

DETAILED DESCRIPTION OF THE PREFERRED EMBODIMENT

Figure 1:
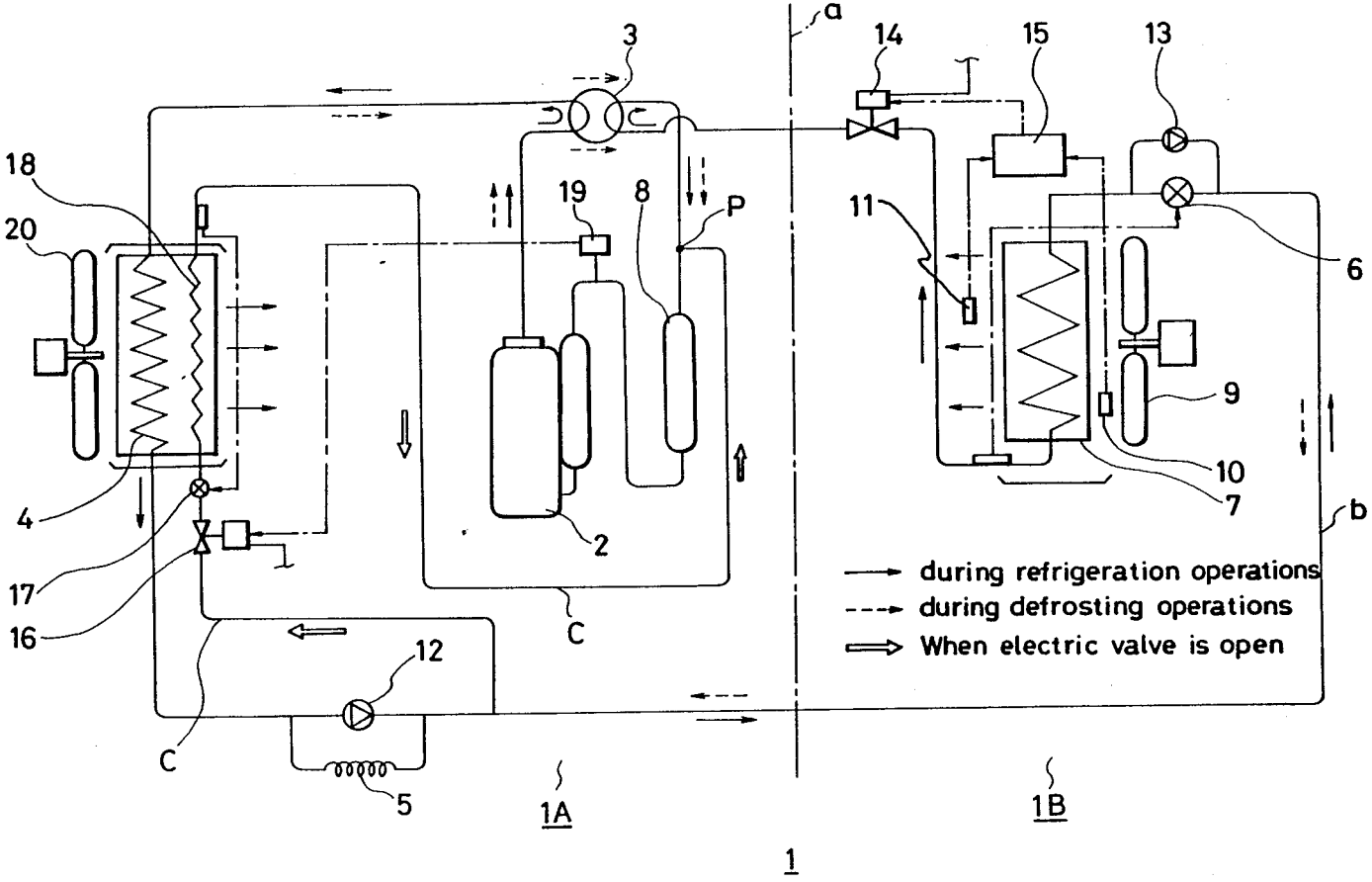
FIG. 1 is a refrigerant circuit of a refrigerating apparatus as embodied according to the invention.

As shown in FIG. 1 the refrigeration apparatus according to the invention comprises outdoor components such as an accumulator 8, a compressor 2, a four-way valve 3, outdoor heat exchangers (which is referred to as condenser) 4, and a capillary tube 5 installed outside 1A of a room delineated by a phantom boundary (a), as well as interior components such as an expansion valve 6 serving as an expansion device, interior heat exchanger (which will be referred to as evaporator) 7 installed inside 1B of the room, which are all connected with pipes for delivering a refrigerant, forming a (closed) circulatory system. The four-way valve 3 may be switched to allow the refrigerant to flow in the direction as indicated by the solid arrows during refrigeration operations, and to flow in the direction indicated by dotted arrows during defrosting operations. Near the evaporator 7 is an indoor blower 9 for blowing the air on the evaporator 7 to cool the room during refrigerating operations. At the air inlet side and outlet port side of the evaporator 7 are inlet temperature sensor 10 and outlet temperature sensor 11, respectively. The temperature detection signals from these temperature sensors 10 and 11 are both input to a valve opening regulating device 15. It is noted that a capillary tube 5 and an expansion valve 6 are connected in parallel with check valves 12 and 13, respectively.

The low pressure side (or the outlet side of the evaporator 7 in the case of refrigeration in this embodiment) of the refrigeration apparatus (or, more specifically, main refrigerant line (b)) is connected with a refrigerant flow rate control valve 14, whose valve openin is controlled by a valve opening regulating device 15.

Between the outlet side of the condenser 4 (or the outlet side of the capillary tube 5 in this case) and the outlet side of the evaporator 7 (or the inlet side of the accumulator 8 in this case) are provided an electric valve 16 (which is an electromagnetic valve in this embodiment and is hence hereinafter referred to as electromagnetic valve) actuated by electric signals serving as opening-closing means for the refrigerant line, an expansion valve 17, which is similarly actuated by electric signals, serving as an expansion means, and an auxiliary evaporator 18, all connected in series. An auxiliary line c serving as a bypass for an evaporator 7, an expansion valve 6, and a refrigerant flow rate control valve 14 are also connected. The auxiliary evaporator 18 is arranged in parallel with the condenser 4 and in the down stream of the air stream furnished by an outdoor blower 20. The electromagnetic valve 16 is controlled by a low pressure switch 19 positioned at the inlet side of the compressor 2 (or the outlet side of the accumulator 8) as it opens and closes.

Namely, as the suction pressure for the compressor 2 lowers below a predetermined pressure $P_1$ (e.g. 0.5 kg/cm), the low pressure switch 19 is closed and a solenoid 42 is energized to open the electromagnetic valve 16, while, as the suction pressure exceeds a predetermined pressure $P_2$ (where $P_2 > P_1$, and $P_2$ is 2.5 kg/cm, say), the low pressure switch 19 is opened and the electromagnetic coil is de-energized to close the electromagnetic valve 16).

Alternatively, instead of the low pressure switch 19 and the electromagnetic valve 16, a suction pressure regulating valve may be provided at a confluence point P of a low pressure side of the refrigerant line where the refrigerants flowing from the auxiliary line c into the accumulator 8 and from the four-way valve 3 into the accumulator 8 meet, so that the flow rate of the bypassing refrigerant from the auxiliary line may be regulated depending on the pressure in the low pressure line.

The refrigerant flow rate control valve 14 is such that its opening is controlled in response to electric signals by adjusting the force acting on the spring abutting on the valve shaft of the refrigerant flow rate control valve 14. This valve is controlled by DC signals and is completely closed when a predetermined voltage (12 V in this example) is applied and fully opened when 0 V is applied. The opening of the valve increases with the decreasing applied voltage which varies between the predetermined voltage and the 0 volt.

Figure 2:
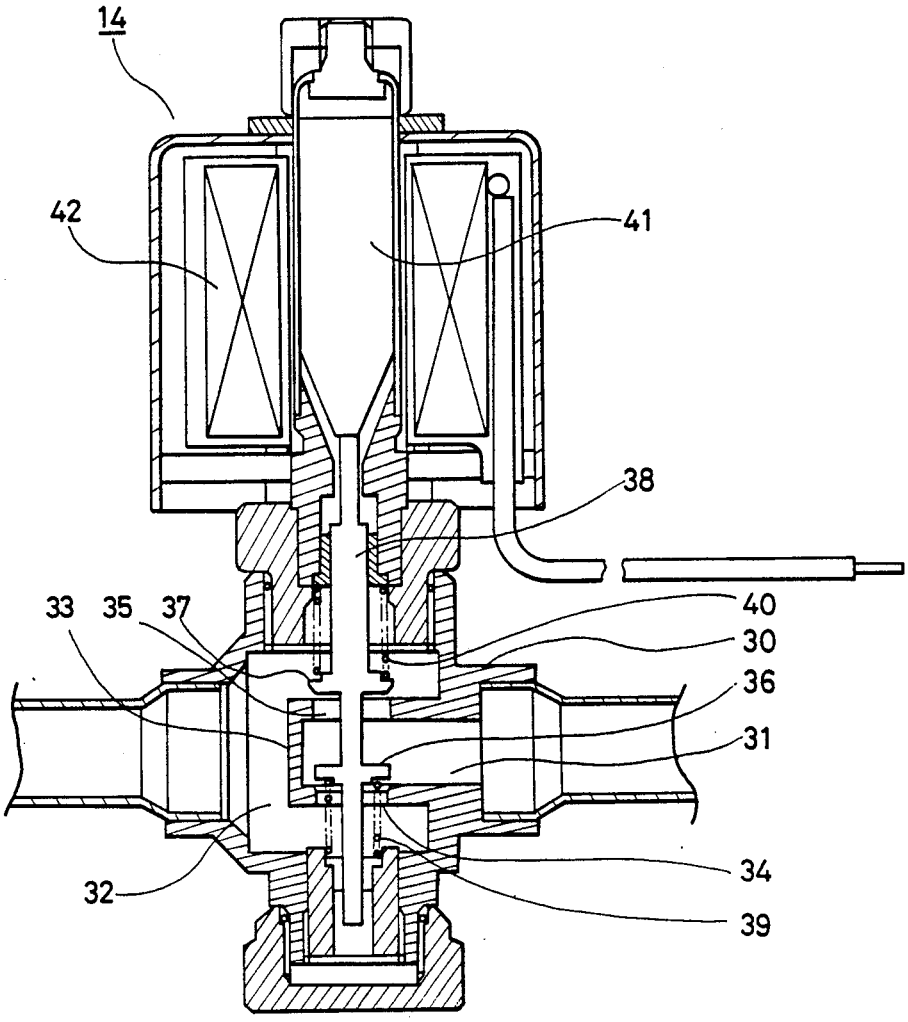
FIG. 2 is a schematic cross section of a refrigerant flow rate control valve installed at the outlet side of an evaporator in a main refrigerant line of FIG. 1.

This refrigerant flow rate control valve 14 belongs to one type of electromagnetic control valves having a constitution as shown in FIG. 2. The body of the valve 30 has a refrigerant inlet 31 connected with the outlet side of the evaporator, and a refrigerant outlet 32 connected with the refrigerant inlet side of a four-way valve 3 (see FIG. 1). The separator 33 separating the valve body into two chambers 31 and 32 is formed with bores 34 and 35 communicating the two chambers. Valve seats 36 and 37 formed for opening-closing the communicating bores 34, 35 are provided on the valve shaft 38. One valve seat 36 is positioned at the inlet side, while the other valve seat 37 is positioned at the outlet side. Compressed coil springs 39 and 40 are installed at the outlet side, but inside, of the valve body for biassing the valve seats 36 and 37 toward their directions for opening. (On the other hand), an actuating piece 41 drives the shaft upward or downward by the magnetic force furnished by the magnetic field of the actuating solenoid 42 energized by electric signals.

The valve seats 36 and 37 are fully opened when no voltage is applied across the solenoid 42, and completely closed when a predetermined voltage is applied across the coil. They may have greater openings for a smaller applied voltage. It will be understood that this refrigerant flow rate control valve 14 is so constituted as to continuously vary its opening from the fully opened condition to the completely closed condition and vice versa.

Figure 3:
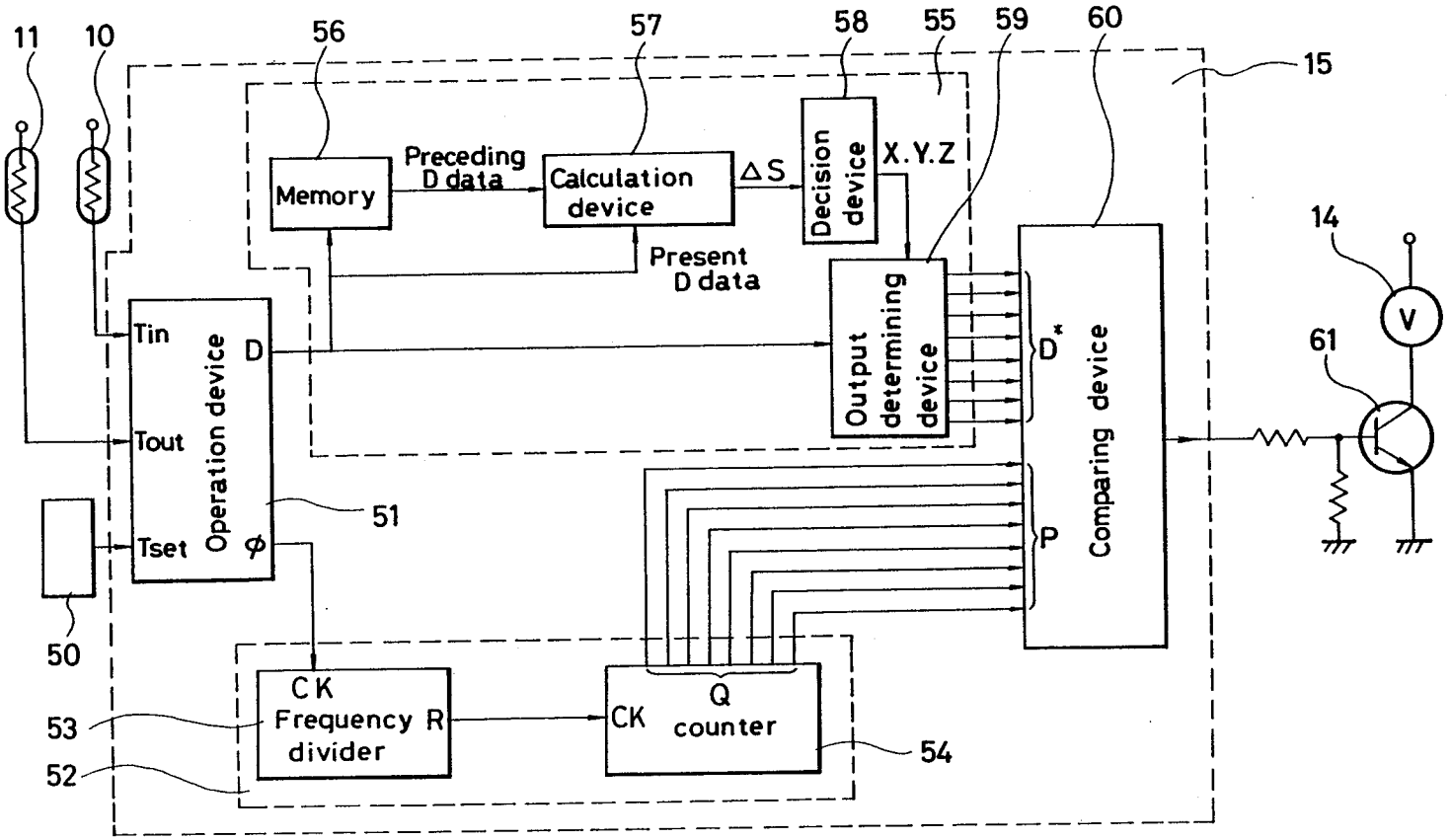
FIG. 3 is a block diagram of a valve opening regulating device for controlling the opening of the above refrigerant flow rate control valve.

A valve opening control device 15 receives signals from a temperature setting device 50 for presetting the desirable room temperature and, based on the signals, forms electric signals having different ON-OFF duty ratio so as to control the opening of the refrigerant flow-rate control valve 14, as shown in FIG. 3. The valve opening regulating device 15 is meant to provide electric signals that may quickly vary the opening of the valve 14, since the magnetic core of the solenoid 42 of the refrigerant flow rate control valve 14 exhibits a hysteresis when it is magnetized and hence without the regulating device 15 the refrigerant flow rate control valve 14 may not quickly alter the valve opening in response to the electric signal (particularly when an increasing voltage is changed to decreasing one and vice versa).

Therefore, upon receiving signals from the temperature setting device 50 and from the room temperature sensors 10 and 11, an operation device 51 samples the signals appropriately (for example for every 15 seconds) to get an average temperature (which is regarded as the room temperature). The device further undergoes proportional-integration-differentiation operations (or PID operations) on the average temperature and the preset temperature, and outputs the results on its output terminals D after converting them into 8-bit signals. (The output data are called D data.) The operation device 51 also sends out reference clock pulses (which are of 2 MHz) from its output terminal $\phi$. A counter device 52 consists of a frequency divider 53 which receives the reference clock pulses and divides them into appropriate divisions to form clock pulses (e.g. pulses of 31.25 KHz obtained by dividing the reference clock pulses by 64 in this example), and a counter 54 for counting these clock pulses in unit of 8-bit binary number or counting them in 256 steps, and outputs the 8-bit binary signals on output terminals Q. These output signals, being ramp signals which vary in a stepped fashion, are hereinafter called P data, and have a period of frequency of about 1/120 second.

A correction device 55 receives D data which are output from the operation device 51 and compares them with the previous D data to decide whether the data are increasing or decreasing, and make a due correction based on the decision. In other words, the correction device 55 comprises a memory 56 which stores D data as they are input and outputs the preceding D data stored previously (which are called preceding D data; the initial D data are given maximum values), a calculating device 57 that accepts the present and preceding D data to calculate the difference between them and provides difference data usable in deciding the trend of the D data, a decision device 58 which outputs instruction data for instructing the correction of D data by deciding the trend of the D data based on the difference data input thereinto, and an output determining device 59 which receives the instruction data and makes correction on the D data input thereinto, outputting the corrected values in the forms of corrected D data.

A comparison device 60 receives the corrected D data from the correction device 55 as well as the P data from the counting device 52, and compare them to output Hi level signals (which has a predetermined voltage Vcc and is hereinafter referred to as "H" signals) or Lo level signal (which has 0 voltage and is hereinafter referred to as "L" signals). Thus, the operation device 51, the counting device 52, the correction device 55 and the comparison device 60 constitute the valve opening regulating device.

The output of the valve opening regulating device 15 is input to a base of a switching transistor 61 (which is hereinafter referred to as transistor) functioning as a switching element. The emitter of the transistor 61 is grounded and the collector is connected with a predetermined voltage source of Vcc (=12 Volts) via the refrigerant flow rate control valve 14 (which is specifically operated by an electromagnetic coil). When the output from the valve opening regulating device 15 is "H", the transistor 61 is switched on to turn on the electromagnetic coil, tending the valve to close, but the valve tends to open when the signal is "L" and the transistor 61 is turned off. The valve is tended to fully open and close in one cycle. Since, however, the valve cannot follow this change mechanically, it settles down at a stable position where its aperture corresponds to the average voltage as determined by the ON-OFF duty ratio.

Figure 4:
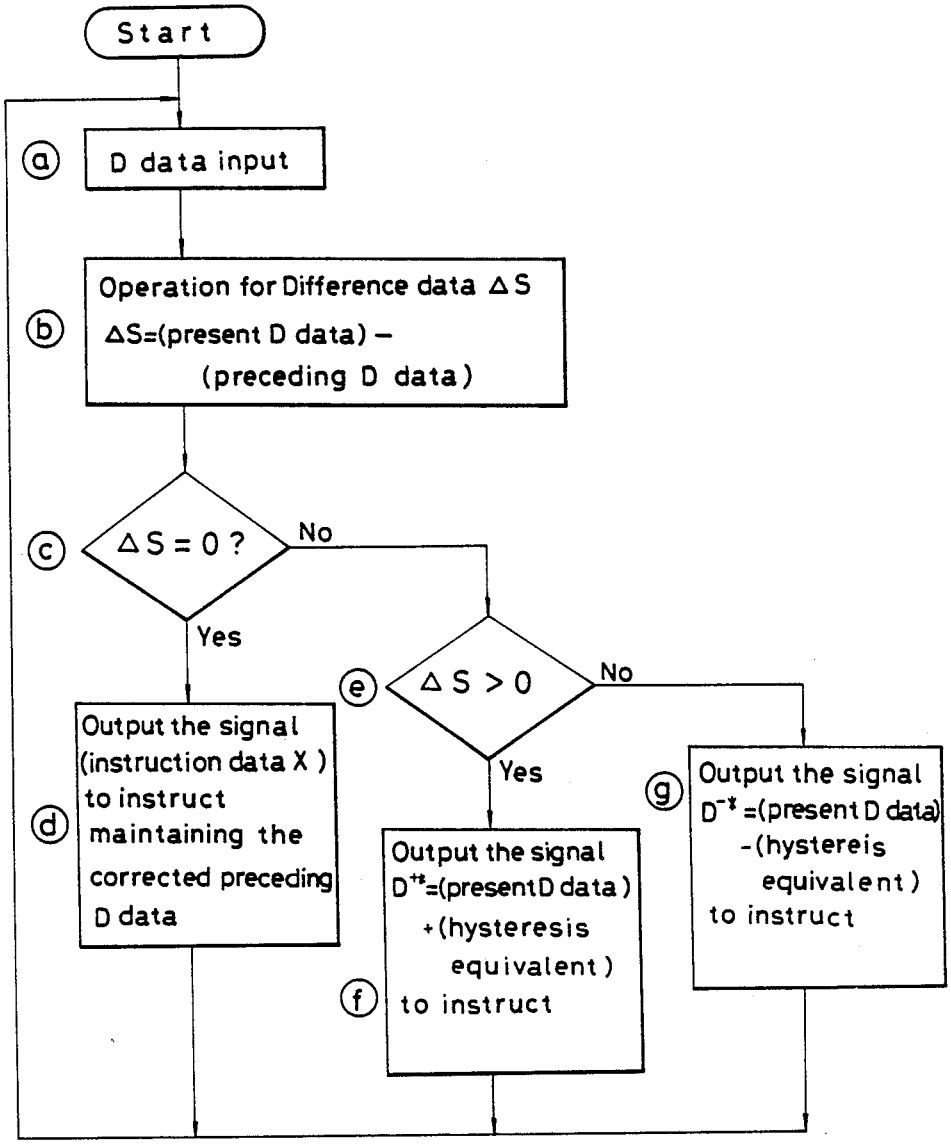
FIG. 4 is a flowchart of the operations of the correction device provided in the above valve opening regulating device.
Figure 5:
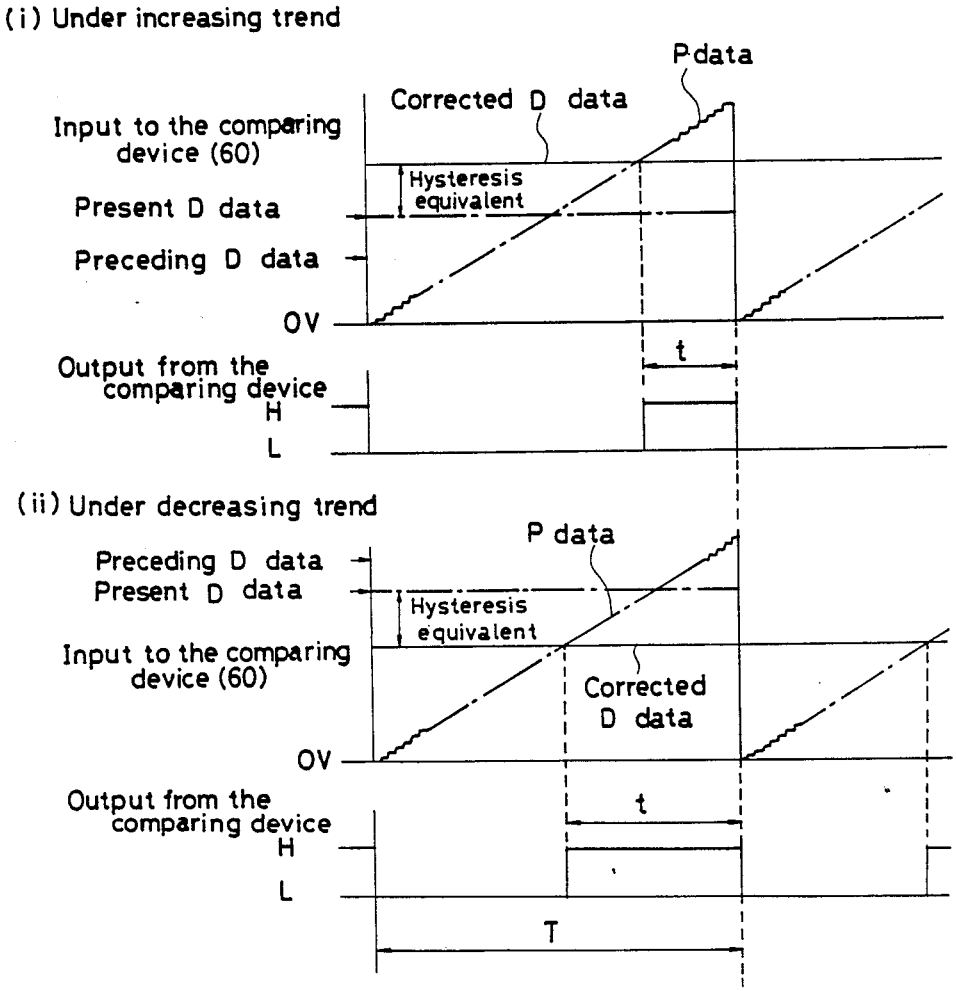
FIG. 5 is the wave forms of the signals input to and output from the above valve opening regulating device.

Referring further to FIGS. 4 and 5 the refrigerating operations of the refrigerating apparatus constituted as above will be described below. The four-way valve 3 is switched to a state as shown in FIG. 1 during a refrigerating operation, when the refrigerant line is formed in the direction indicated by solid arrows. Presently it is assumed that appropriate amount of preserving goods are stored in the refrigerating room and that the room temperature exceeds the preset temperature.

Receiving the signals from the roo temperature sensors 10 and 11 the valve opening regulating device 15 determines the opening of the valve and transmits a signal to change the opening of the refrigerant flow rate control valve 14. The high pressure gaseous refrigerant sent forth from the compressor 2 is liquefied in the condenser 4, expanded at a reduced pressure across the expansion valve 6, exchanges heat with the air in the room while it passes through the evaporator 7, and returns to the compressor 2 via the accumulator 8 as a low pressure refrigerant gas after the flow rate is controlled by the refrigerant flow rate control valve 14. The refrigerant cools the air in the room to the preset temperature as it circulates through the main refrigerant line b.

The operations of the refrigerant flow rate control valve 14 and the valve opening regulating device 15 will be described now. Receiving the signals from the room temperature sensors 10 and 11, the operation device 51 samples both signals at an appropriate period (for example 15 second) to obtain their average as the room temperature, and undergoes PID calculation for the preset temperature and outputs D data from on its output terminals D. The data are generally low in value when the difference between the room temperature and the preset temperature is great, but becomes higher as the difference becomes smaller. On the other hand the counting device 52 generates clock pulses by means of reference clock signals output from the operation device 51, and counts these clock pulses in 256 steps over one period T (which is in this example about 1/120 of a second). These counts are output as P data from the output terminals Q to a comparing device 60.

Referring to the flowchart shown in FIG. 4 the operation of the correction device 55 receiving the D data will now be described. As the D data are input into the correction device 55 (see FIG. 4(*a*)), the memory 56 outputs the D data that precedes, which are used to calculate the difference data $\Delta S$ [=(present D data)−(preceding D data)](see FIG. 4(*b*)). Based on this difference data $\Delta S$ the decision making device 58 decides the trend of the D data. Namely, the decision making device 58 first decides whether or not $\Delta S=0$ (FIG. 4(*c*)). When $\Delta S=0$, a decision that "No change is observed in D data" is made, and outputs a "signal to maintain the preceding D data" (i.e. the instruction data X) (see FIG. 4(*d*)). When $\Delta S=0$, a decision is made as to $\Delta S>0$ or $\Delta S<0$ (see FIG. 4(*e*)). When $\Delta S>0$, a decision that "D data are increasing" is made and the outputs a "signal to instruct that the corrected D data $D^{+*}$=(present D data)+(hysteresis equivalent) [or instruction data Y], as shown in FIG. 5 (see FIG. 4(*f*)). When $\Delta S<0$, a decision that "D data D are decreasing" is made and outputs a "signal to correct D data by $D^{-*}$=(present D data) - (hysteresis equivalent) [i.e. instruction data Z](see FIG. 4(*g*)). Based on the instruction data X, Y, and Z, the output determining device 59 outputs corrected D data. It should be noted that the output determining device 59 temporarily stores the corrected D data as it outputs the corrected D data, and outputs the preceding corrected D data in association with the instruction data X determined presently, and outputs corresponding corrected D data in association with the present D data Y and Z. Although the "hysteresis equivalent" changes in magnitude, depending on the amplitude of the hysteresis causing a major source of the operational delay of the employed valve 14 in response to the electric signals given thereto, the hysteresis equivalent is set at the magnitude half the hysteresis amplitude in this example.

The comparing device 60 compares the corrected D data with the P data to output "L" signals when the corrected D data are greater than the P data ($P<D^{+*}$ or $P<D^{-*}$), while it outputs "H" signals when the corrected D data are equal to or smaller than the P data ($P\geqq D^{-*}$ or $P\geqq D^{-*}$. Therefore, when the difference is great, the time interval t for outputting "H" signals in the period T is short, and as the difference becomes shorter, the period t for outputting the "H" signals becomes longer. In other words, the output voltage Vt in one period T may be represented by a formula [$Vt = Vcc \times t/T$]. Since the length of t inversely varies with the difference value, it assumes a small value for a large difference, and a large value for a small difference.

The transistor 61 is turned on only over the period t during which "H" signals are output, and the refrigerant flow rate control valve 14 is turned on 1/T times over the period t per one second. This substantially amounts to applying voltage of [$Vt = Vcc \times t/T$]to the refrigerant flow rate control valve 14, which makes the valve to stop at the position where its opening corresponds to the voltage Vt.

It should be noted that the frequency f (=1/T) of the electric signal output from the comparing device 60 should be chosen close to, but greater than, the resonance frequency fL of the spring abutting on the valve shaft of the refrigerant flow rate control valve 14 and in the range where no resonance with the spring takes place. (In this embodiment, f=120 Hz.) If the frequency f becomes identical with the resonance frequency fL, the control valve itself will resonate with the spring and fails to function as a valve. Setting the frequency as above, the hysteresis of the valve under the voltage applied thereto is minimized and as a result the response of the valve is improved.

In this manner, based on the temperatures detected by the room temperature sensors 10 and 11, the opening of the valve 14 may be regulated by the valve opening regulating device 15 as required to maintain the room temperature at a predetermined level. But when the amount of the foods stored in the room is small and, furthermore, the opening-shutting frequency of the door is low, the room temperature lowers in the course of continuous refrigeration, tending the opening of the refrigerant flow rate control valve 14 to diminish and consequently the pressure on the suction side of the compressor 2 gradually lowers.

As the pressure on the suction side lower below a predetermined pressure $P_1$, the low pressure switch 19 is closed, opening the electromagnetic valve 16. Therefore a part of refrigerant passing through the condenser 4 is branched from the main refrigerant line b into an auxiliary line c. Since then the auxiliary evaporator 18 in the auxiliary line c is located leeward of the condenser 4, it is warmed by the warm air heated by the condenser 4 by heat exchange, so that the evaporation temperature of the auxiliary evaporator 18 becomes higher than that of the evaporator 7 even when the same amounts of refrigerant flow into them. With this flow of refrigerant into the auxiliary line c, the amount of the refrigerant into the accumulator 8 is increased and the pressure on the suction side of the compressor 2 is gradually increased. On the other hand with the flow of refrigerant into the auxiliary refrigerant line c, the amount of the refrigerant flowing in the main refrigerant line b is decreased, which then lowers the refrigeration power of the evaporator 7 to thereby decrease temperature lowering in the room and suppress a decrease in the opening of the refrigerant flow rate control valve 14. As this condition lasts, however, when the room temperature drops even after the auxiliary line c is open to shunt the refrigerant, the refrigerant flow rate control valve 14 has its opening decreased further, and may be closed in an extreme situation. It should be noted, however, that even in this case, the auxiliary line c is kept open to provide the compressor 2 with low-pressure copensation which prevents the compressor from stopping its operation. Therefore, as the room temperature rises (due to the stoppage of refrigerant through the refrigerant flow rate control valve 14) and the refrigeration operation is resumed (i.e., the valve 14 is opened), the time required by the evaporator 7 to come back to the predetermined temperature is shorter. This makes it possible to reduce the fluctuation in room temperature, providing improved refrigeration performance, particularly in the freezing temperature range. On the other hand, if the main line d and the auxiliary line c are kept open continually, the pressure on the suction side gradually builds u and exceeds a predetermined pressure $P_2$; the low pressure switch 19 is released; the electromagnetic valve 16 is closed; and the refrigerant flow into the auxiliary line c is shut down, so that the operation is switched back to the refrigeration that uses the main refrigeration line b only.

By repeating the same procedures in refrigerating operations, the pressure on the suction side of the compressor 2 is prevented from lowering greatly below $P_1$, and therefore continuous running of the refrigeration apparatus is possible without stopping the compressor 2. Namely, pressure lowering in the compressor 2 is compensated so that the continuous running is allowed and that the room temperaturre is maintained constant regardless of opening-shutting frequency of the door and change in the amount of the foods stored, making the refrigerating apparatus suitable for preserving the foods invariably fresh for a long period.

The above description of course holds when such components as room temperature sensors 10 and 11, the valve opening regulating device 15 function normally. Should these components fail to operate, it would be feared that the foods stored in the room would deteriorate, entailing a heavy loss depending on their kinds and amount. In order to prevent such inconvenience, the embodiment of invention is provided with an operation-protective mean 70 which secures constant temperature refrigeration of the food.

Figure 6:
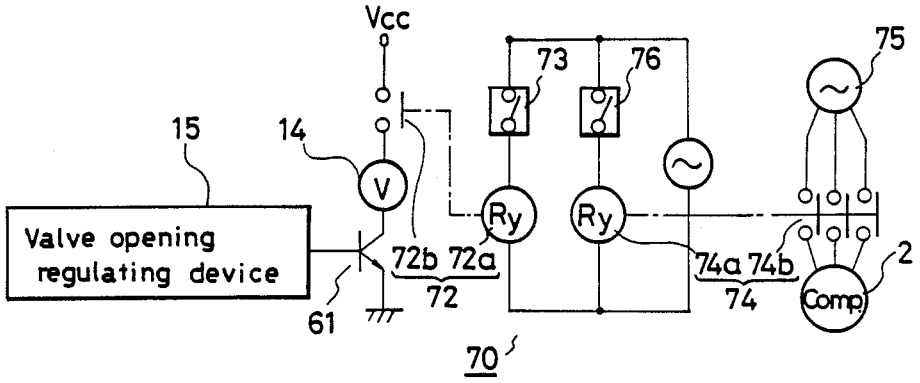
FIG. 6 is a schematic electric circuit diagram of protection means installed in the above refrigeration apparatus.

Namely, in FIG. 6 the output of the valve opening regulating device 15 is input to the transistor 61 connected with the solenoid 42 of the refrigerant flow rate control valve 14. The refrigerant flow rate control valve 14 is connected with a DC power supply via a forcible full opening switch 72 which forcibly brings the valve to a fully opened condition. The forcible full opening switch 72 consists of an auxiliary relay **72*a* connected in series with a thermostat 73 (which will be referred to as overheat-prevention thermostat) for preventing abnormal overheating of the room and a normally closed contact 72*b* connected with the refrigerant flow rate control valve 14. The normally closed contact 72*b* is opened while the auxiliary relay 72*a* is turned on, and closed while the relay is turned off. The overheat-prevention thermostat 73 undergoes an ON-OFF operation at a temperature higher than the upper limit temperature (which is hereinafter referred to as abnormally high temperature) for fully opening the valve which has been set by the valve opening regulating device 15**.

On the other hand the compressor 2 is connected with a three-phase AC power supply 75 via a forcible stopping switch 74. The forcible stopping switch 74 consists of a normally opened contact **74*b* connected in series with the compressor 2, and an auxiliary relay 74*a* connected in series with a thermostat 76 (which will be hereinafter referred to as undercooling-prevention thermostat) for preventing abnormal cooling of the refrigerating room. The normally opened contact 74*b* is closed while the auxiliary relay 74a is turned on, and opened while the relay is turned off. The undercoolingprevention thermostat 76 undergoes an ON-OFF operation at a temperature lower than the lower limit temperature (which will be referred to as abnormally low temperature) for closing the valve set by the valve opening regulating device 15**.

Figure 7:
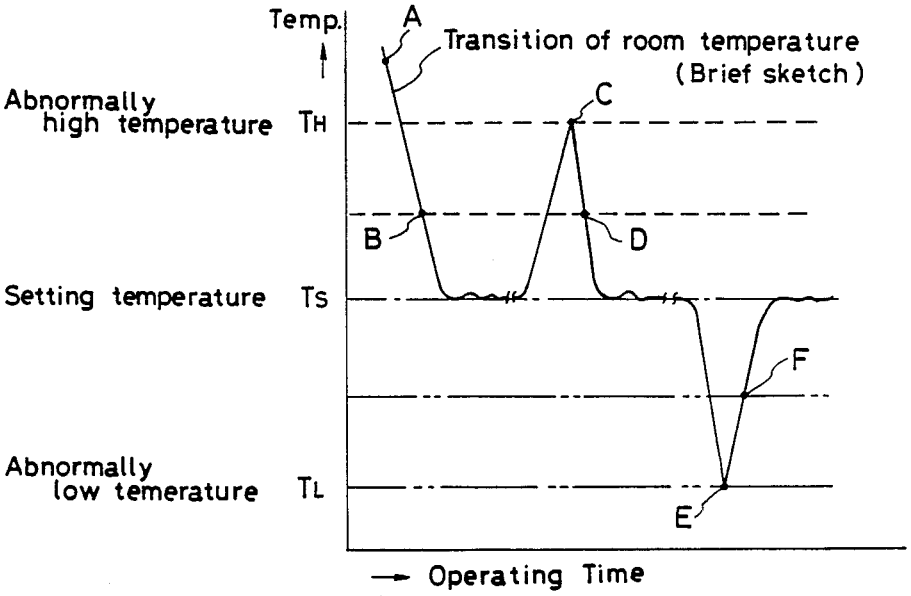
FIG. 7 is a graph used for explaining the operations of the above protection means.

The operation-protective means 70 thus constituted operates as follows. At the time of starting the operation or pull down operation of the refrigeration apparatus 1 (see point A in FIG. 7), the overheating-prevention thermostat 73 is closed, and the auxiliary relay 72a of the forcible full opening switch 72 is turned on to open the normally closed contact 72b. Because of this the refrigerant flow rate control valve 14 is kept open regardless of the output of the valve opening regulating device 15, so that a maximum amount of the refrigerant is furnished to the evaporator 7, providing maximum refrigeration power obtainable by the evaporator 7. In this case the compressor 2 is in operation with the undercooling-prevention thermostat 76 closed, and the auxiliary relay 74a of the forcible stopping switch 74 turned on to close the normally opened contact 74b. Under the maximum power refrigeration the temperature of the refrigerating room is gradually lowered, and as the overheating-prevention thermostat 73 is opened (see point B in FIG. 7) the normally closed contact 72b of the forcibly full opening switch 72 is closed. The opening of the refrigerant flow rate control valve 14 then corresponds to the output of the valve opening regulating device 15. The refrigeration is so continued until the room temperature reaches the preset temperature Ts. Thereafter the valve opening regulating device 15 regulates the opening of the control valve 14 as to maintain the room temperature at the preset temperature.

On the other hand, if for some reason the temperature of the refrigerating room deviates greatly from the desired preset temperature Ts ot the abnormally high temperature TH (see point C in FIG. 7), the overheating-prevention thermostat 73 is closed and the auxiliary relay 72a of the forcible full opening switch 72 is turned on to open the normally closed contact 72b open. Therefore the refrigerant flow rate control valve 14 is kept open regardless of the output of the valve opening regulating device 15, permitting the maximum flow rate of the refrigerant through the main refrigerant line b, in particular, through the evaporator 7 and providing maximum refrigerating power obtainable by the evaporator 7. Since in this case, however, the undercooling-prevention thermostat 76 is kept closed, the normally opened contact 74b of the forcible stopping switch 74 remains closed, and the compressor 2 continues its operation unchanged. Hence, under the maximum refrigeration by the evaporator 7 the temperature of the refrigerating room is gradually lowered. As the overheating-prevention thermostat 73 is opened (see point D in FIg. 7), the normally closed contact 72b of the forcible full opening switch 782 is closed, when the refrigerant flow rate control valve 14 changes its opening in accordance with the output of the valve opening regulating device 15, thereby providing refrigeration corresponding to that opening. If the valve opening regulating device 15 operates normally thereafter, the refrigeration is continued at the refrigerant flow rate corresponding to the valve opening determined by the output of the device, so that the room temperature is maintained at prescribed low temperature Ts.

If for some other reasons the room temperature deviates greatly away from the preset temperature Ts to the abnormally low temperature TL (see point E in FIG. 7), the undercooling-prevention thermostat 76 is opened to turn off the auxiliary relay 74a of the forcible stopping switch 74, oipening the normally opened contact 74b which has been closed up until then. This turns off the compressor 2, so that the flow of the refrigerant is stopped. Thus no refrigerant will flow into the evaporator 7 and refrigeration is interrupted, preventing the room from being further cooled. The interruption of the refrigeration permits the room to restore a higher temperature until the auxiliary relay 74a of the forcible stopping switch 74 is turned on to close the normally opened contact 74b at the temperature at which the undercooling-prevention thermostat 76 is closed (see point F in FIG. 7). This makes the compressor 2 resume its operation for refrigeration. If the valve opening regulating device 15 operates normally, the refrigeration is continued with the valve opening corresponding to the output of the device, thereby maintaining stably the room temperature at the preset temperature Ts.

As described above, in a case when the room temperature happens to be abnormally high for some reasons, the refrigeration apparatus is brought ot the state of maximum refrigeration power by forcibly and fully opening the refrigerant flow rate control valve 14, thereby quickly lowering the room temperature and preventing food deterioration due to abnormal high temperature. On the other hand when the room happens to become abnormally undercooled, the compressor 2 is forcibly stopped to prevent the freezing of the foods and the valve opening regulating device 15 as well. In any case, the flow rate of the refrigerant is controlled independently of the output of the valve opening regulating device 15, and so is the room temperature even if this device is damaged, thereby securing suitable temperature control of the refrigeration room for food preservation.

What is claimed is:

1. A refrigeration apparatus having a main refrigerant line which comprises a compressor, a condenser, an expansion device, and an evaporator all arranged in a loop, characterized in that said refrigeration apparatus further comprises:

a refrigerant flow rate control valve installed at the outlet side of said evaporator;

an auxiliary refrigerant line for bypassing said evaporator and refrigerant flow rate control valve, having a refrigerant-line opening-closing means, an expansion means, and an auxiliary evaporator, and installed between the outlet side of said condenser and the outlet side of said refrigerant flow rate control valve, and that said compressor is run without interruption by opening the refrigerant-line opening-closing means as the suction pressure of the compressor lowers below predetermined value.

2. A refrigeration apparatus as defined in claim 1 wherien the openings of said refrigerant-line opening-closing means comprise an electric valve whose opening is controlled by electric signals.

3. A refrigeration apparatus as defined in claim 1 further comprises: a temperature setting device for presetting a desirable refrigeration room temperature; temperature sensors for sensing the room temperature; and a valve opening regulating device for controlling the opening of said refrigerant flow rate control valve by means of the temperature signals given by said temperature sensors and the preset temperature signals given by said temperature presetting device.

4. A refrigeration apparatus as defined in claim 3, wherein said refrigerant flow rate control valve comprises a spring for biassing the valve shaft thereof toward its opening direction, and a solenoid for driving the valve in the closing direction against the force of the spring, and wherein said valve opening regulating device provides said solenoid with electric signals based on the difference between the temperature signals given by the temperature sensors and the preset temperature signals.

5. A refrigeration apparatus as defined in claim 4, wherein said valve opening regulating device comprises:

an operation device that carries out operations on the signals given by said temperature sensors and the temperature presetting device for getting and controlling the difference therebetween;

a correction device that decides whether the values obtained in the operation are increasing, decreasing, or invariant by comparing the present output from the operation device with the preceding one, and outputs corrected values obtained by, depending on the decision, adding to or subtracting from the present value an operational hysteresis equivalent, or doing nothing with the present value;

a comparing device that compares the corrected values with signals having a given period and provides the solenoid of said refrigerant flow rate control valve with the electric signals having a duty ratio corresponding to the result of the comparison.

6. A refrigeration apparatus as defined in claim 1 further comprises:

an overheating-prevention thermostat for detecting an overheating room temperature and fully opening said refrigerant flow rate valve forcibly when such abnormally high temperature is detected;

an undercooling-prevention thermostat for forcibly stopping the operation of the compressor when an abnormally low room temperature is detected, thereby giving operational protection to the refrigeration apparatus.

* * * * *